US008092048B2

(12) United States Patent
Zheng

(10) Patent No.: US 8,092,048 B2
(45) Date of Patent: Jan. 10, 2012

(54) LED LAMP

(75) Inventor: Shi-Song Zheng, Shenzhen (CN)

(73) Assignees: Fu Zhen Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 340 days.

(21) Appl. No.: 12/491,248

(22) Filed: Jun. 25, 2009

(65) Prior Publication Data

US 2010/0110687 A1 May 6, 2010

(30) Foreign Application Priority Data

Oct. 30, 2008 (CN) ..... 2008 1 0305312

(51) Int. Cl.
*F21S 4/00* (2006.01)
*F21S 8/00* (2006.01)
*F21V 21/00* (2006.01)

(52) U.S. Cl. ..... 362/249.06; 362/147; 362/150

(58) Field of Classification Search ..... 362/249.06, 362/147, 148, 150
See application file for complete search history.

(56) References Cited

U.S. PATENT DOCUMENTS

| | | | | |
|---|---|---|---|---|
| 3,319,059 | A * | 5/1967 | Ogden | 362/219 |
| 4,413,311 | A * | 11/1983 | Orenstein | 362/219 |
| 4,712,165 | A * | 12/1987 | Cetrone | 362/147 |
| 5,559,681 | A * | 9/1996 | Duarte | 362/231 |
| 6,969,179 | B2 * | 11/2005 | Sloan et al. | 362/219 |
| 7,063,440 | B2 * | 6/2006 | Mohacsi et al. | 362/240 |
| 7,170,751 | B2 * | 1/2007 | Mayer | 361/719 |
| 7,645,052 | B2 * | 1/2010 | Villard | 362/147 |
| 7,726,840 | B2 * | 6/2010 | Pearson et al. | 362/249.06 |
| 7,753,577 | B2 * | 7/2010 | Teeters | 362/576 |
| 2003/0210546 | A1 * | 11/2003 | Chin | 362/249 |
| 2006/0221632 | A1 * | 10/2006 | Hsu | 362/604 |
| 2006/0262521 | A1 * | 11/2006 | Piepgras et al. | 362/149 |
| 2007/0133193 | A1 * | 6/2007 | Kim | 362/147 |
| 2008/0266842 | A1 * | 10/2008 | Skidmore et al. | 362/147 |
| 2009/0207602 | A1 * | 8/2009 | Reed et al. | 362/225 |

FOREIGN PATENT DOCUMENTS

| | | |
|---|---|---|
| CN | 2899117 | 5/2007 |
| CN | 201028340 | 2/2008 |

* cited by examiner

*Primary Examiner* — Jong-Suk (James) Lee
*Assistant Examiner* — David J Makiya
(74) *Attorney, Agent, or Firm* — Altis Law Group, Inc.

(57) ABSTRACT

An LED lamp includes a lamp body, a casing connecting the lamp body and a position post connecting the casing. The lamp body includes a plurality of lamp modules and at least a bracket. Each of the lamp modules includes a heat sink and an LED module attached to the heat sink. The lamp body can be arranged in multi forms by the at least a bracket connecting different numbers of the lamp modules together. The lamp body can have one of the following forms: an L-shaped form, a U-shaped form and a square, loop-shaped form.

10 Claims, 5 Drawing Sheets

LED LAMP

BACKGROUND

1. Technical Field

The present disclosure relates to an LED (light emitting diode) lamp and, more particularly, to an improved LED lamp which can change form of light emitting according to need.

2. Description of Related Art

An LED lamp as a new type of light source can generate brighter light, and have many advantages, e.g., energy saving, environment friendly and longer life-span, compared to conventional light sources. Therefore, the LED lamp has a trend of substituting for conventional lamps.

A conventional LED lamp comprises a plate-shaped heat sink and a plurality of LED modules attached to a bottom of the heat sink. In use of the LED lamp, light generated by the LED modules directly irradiates to an outside of the LED lamp. Since the LED modules are arranged on the heat sink in a certain form tightly/firmly, and light produced by the LED module can only illuminate toward a singular direction. It is difficult to rearrange the LED modules on the heat sink as desired, whereby an application of the LED lamp is prohibited in some fields which needs to arrange LED modules in different forms to meet requirements for illumination of multi-form.

What is needed, therefore, is an LED lamp which can overcome the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
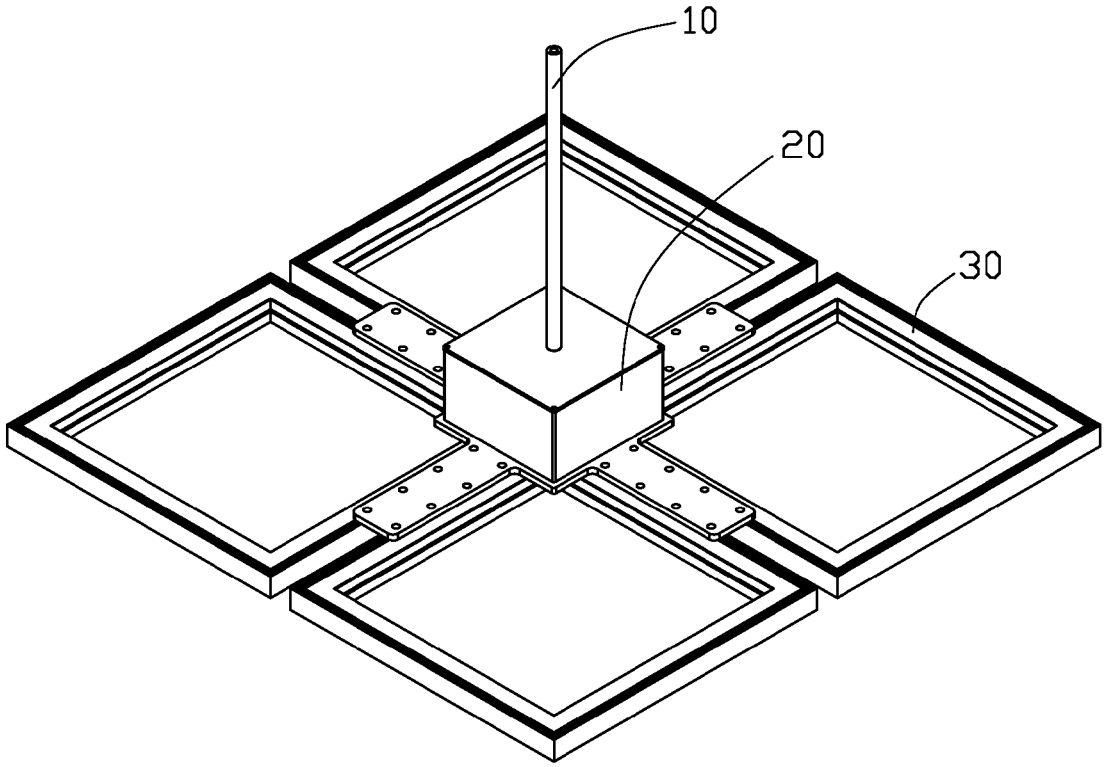
FIG. 1 is an isometric, assembled view of an LED lamp in accordance with a first embodiment of the disclosure.

Referring to FIG. 1, an LED lamp in accordance with a first embodiment of the disclosure includes a position post 10, a casing 20 connecting with the position post 10, four lamp bodies 30 spaced from each other and connecting the casing 20.

Figure 2:
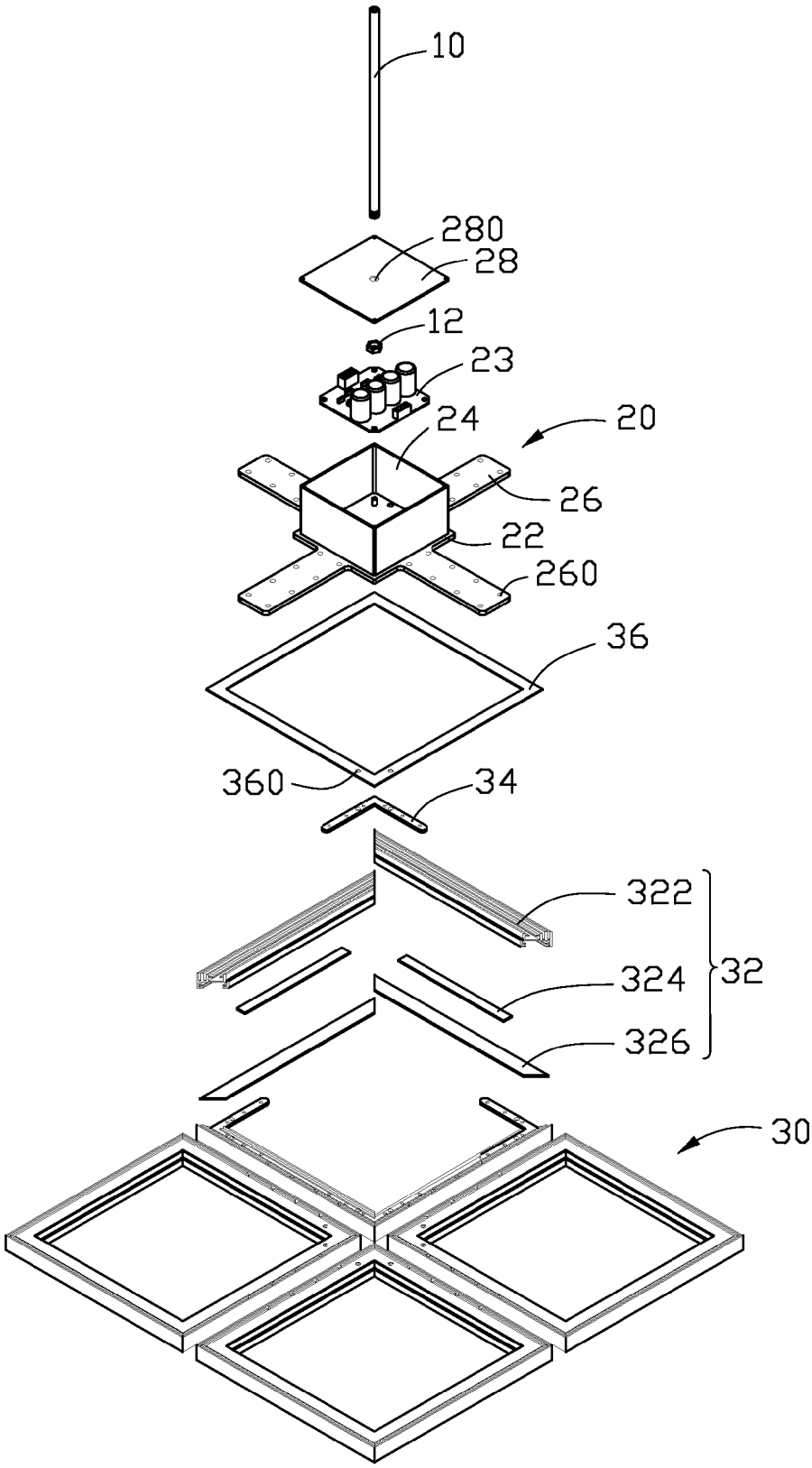
FIG. 2 is an isometric, exploded view of the LED lamp of FIG. 1.

Also referring to FIG. 2, the position post 10 is a cylindrical metal pole. A top end of the position post 10 is fastened on a ceiling of an architecture (not shown) for positioning the LED lamp at a desired location.

The casing 20 is substantially cubic and includes a bottom plate 22, four interconnecting side plates 24 upwardly and vertically extending from four edges of the bottom plate 22, four rectangular flanges 26 horizontally and outwardly extending from the four edges of the bottom plate 22 and a top plate 28 connecting with top edges of the side plates 24 and covering a space between the side plates 24. A driving module

23 is received in the casing 20. Two opposite ones of the flanges 26 are symmetrical about the position post 10. Each flange 26 defines two rows of through holes 260 near two opposite edges thereof. The top plate 28 defines a circular through hole 280 in a center thereof. A bottom end of the position post 10 extends through the through hole 280 of the top plate 28 and threadedly engages with a nut 12 to fasten the position post 10 on the casing 20.

Each lamp body 30 has a square, loop-shaped structure with four sides and includes four lamp modules 32, four brackets 34 received in each lamp body 30 and connecting the lamp modules 32 together and a cover plate 36 covering on a top portion of the four lamp modules 32.

Figure 3:
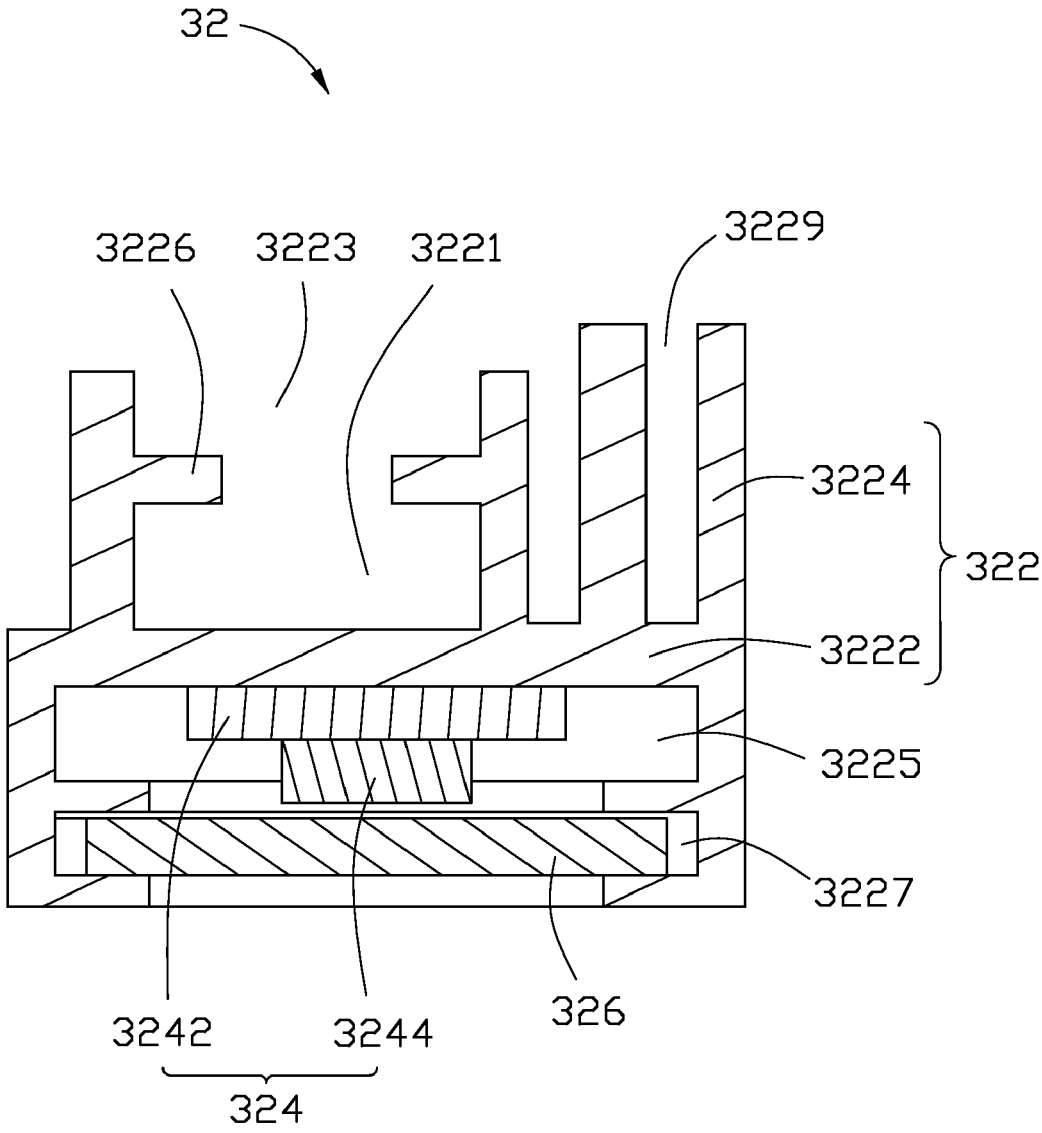
FIG. 3 is a cross-section view of a lamp module of the LED lamp of FIG. 1.

Particularly referring to FIG. 3, each lamp module 32 includes a heat sink 322, an LED module 324 received in and attached to the heat sink 322, and a lens 326 received in the heat sink 322 and covering the LED module 324.

The heat sink 322 is made of metal such as aluminum, copper or an alloy thereof. The heat sink 322 absorbs heat generated by the LED module 324 and dissipates the heat into ambient air when the LED lamp is operated. Each heat sink 322 has a trapezoid shape as viewed from a top. Each heat sink 322 includes a base plate 3222, three pairs of spaced rib plates 3224 vertically extending from top and bottom faces of the base plate 3222, respectively, wherein the first and second pairs of rib plates 3224 extend from the top face of the base plate 3222, and the third pair of rib plates 3224 extends from the bottom face of the base plate 3222. A first pair of baffle plates 3226 extends inwardly from middle portions of the first pair of rib plates 3224 located at a left of the top of the base plate 3222, whereby a space cooperatively defined by the base plate 3222 and the pair of rib plates 3224 at the left of the top of the base plate 3222 is divided/separated into two receiving rooms 3221, 3223. The receiving room 3221 is located near the base plate 3222 and receives an arm (not labeled) of the bracket 34 therein. The receiving room 3223 is located away from the base plate 3222 and receives a side of the cover plate 36 therein. A distance between the first pair of baffle plates 3226 is smaller than a width of each arm of the bracket 34 and a width of each side of the cover plate 36 such that the bracket 34 can be separated from the cover plate 36 by the first pair of baffle plates 3226. The second pair of rib plates 3224 at a right of the top of the base plate 3222 together defines a receiving room 3229. Second and third pairs of baffle plates 3226 inwardly extend from the third pair of rib plates 3224 at a bottom of the base plate 3222 respectively, whereby a space is defined by the base plate 3222 and the third pair of rib plates 3224, in which the space is divided/separated into two receiving rooms 3225, 3227. The receiving room 3225 near the base plate 3222 receives the LED module 324 therein, and the receiving room 3227 away from the base plate 3222 receives the lens 326 therein. A horizontal distance between each of the second and third pairs of baffle plates 3226 is smaller than a width of the lens 326, and a vertical distance between the second and third pairs of baffle plates 3226 is substantially the same as a thickness of the lens 326 such that the lens 326 is sandwiched between the second and third pairs of the baffle plates 3226.

The LED modules 324 each include a rectangular printed circuit board 3242 and a plurality of LEDs 3244 adhered on the printed circuit board 3242. Each LED module 324 is attached on the bottom face of the base plate 3222 of a corresponding heat sink 322. The lens 326 is made of transparent material, such as glass, to allow light to penetrate therethrough. Each lens 326 is trapezoidal in shape corresponding to that of the heat sink 322 and received in the receiving room 3227 for sealing a bottom portion of the lamp module 32.

Each bracket 34 is integrally formed from a flat metal sheet and has two perpendicular arms (not labeled) inserted into the receiving rooms 3221 of two adjacent heat sinks 322 to connect two adjacent lamp modules 32 together. Each bracket 34 has an L-shaped configuration consisting of the two arms perpendicular to each other.

The cover plate 36 is integrally formed from a flat metal sheet. The cover plate 36 has a square, loop-shaped structure with four sides corresponding to the structure of the entire lamp body 30. Each side of the cover plate 36 is received in the receiving room 3223 of the heat sink 322 of a corresponding lamp module 32 and fastened on the first pair of baffle plates 3226 for sealing a top portion of the lamp body 30. Two through holes 360 are defined at a corner where two adjacent sides of the cover plate 36 intersect. The driving module 23 has lead wires (not shown) extending through the through holes 360 and electrically connecting the LED modules 324 to provide power and controlling signals to the LED modules 324.

In assembly, the LED modules 324 each are received in the receiving room 3225 of a corresponding heat sink 322, and the printed circuit board 3242 of the LED module 324 is adhered on the bottom face of the base plate 3222 of the heat sink 322. The lenses 326 each are received in the receiving room 3227 of a corresponding heat sink 322. The two perpendicular arms of each bracket 34 are inserted into the receiving rooms 3221 of two adjacent heat sinks 322 and are fastened on the top faces of the base plates 3222 of the heat sinks 322 via screws (not shown) to securely connect the lamp modules 32 together. The cover plates 36 are received in the receiving rooms 3223 of the connected lamp modules 32 of the lamp bodies 30, respectively. A plurality of screws (not shown) extend through the through holes 260 of the flanges 26 of the casing 20 and engage in the receiving rooms 3229 of the heat sinks 322 to thereby fasten the casing 20 on the assembled lamp bodies 30.

Figure 4:
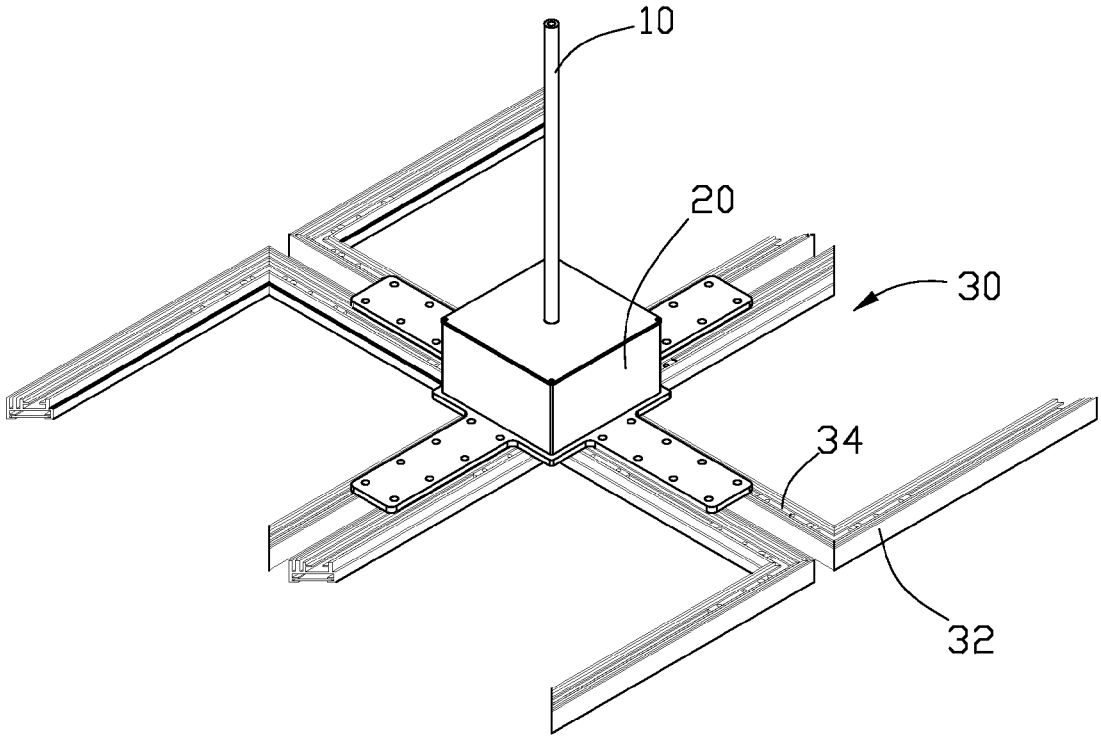
FIG. 4 is an isometric, assembled view of an LED lamp in accordance with a second embodiment of the disclosure.

FIG. 4 shows an LED lamp in accordance with a second embodiment of the disclosure, which has a similar configuration to that of the LED lamp in accordance with the first embodiment. The difference between the LED lamps in the first and second embodiments is that each lamp body 30 in the second embodiment has a U-shaped structure with three sides and includes three lamp modules 32 and two brackets 34 connecting the lamp modules 32 together. In other words, the difference between the LED lamps in the first and second embodiments is that each lamp body 30 in the second embodiment has an open loop-shaped structure.

Figure 5:
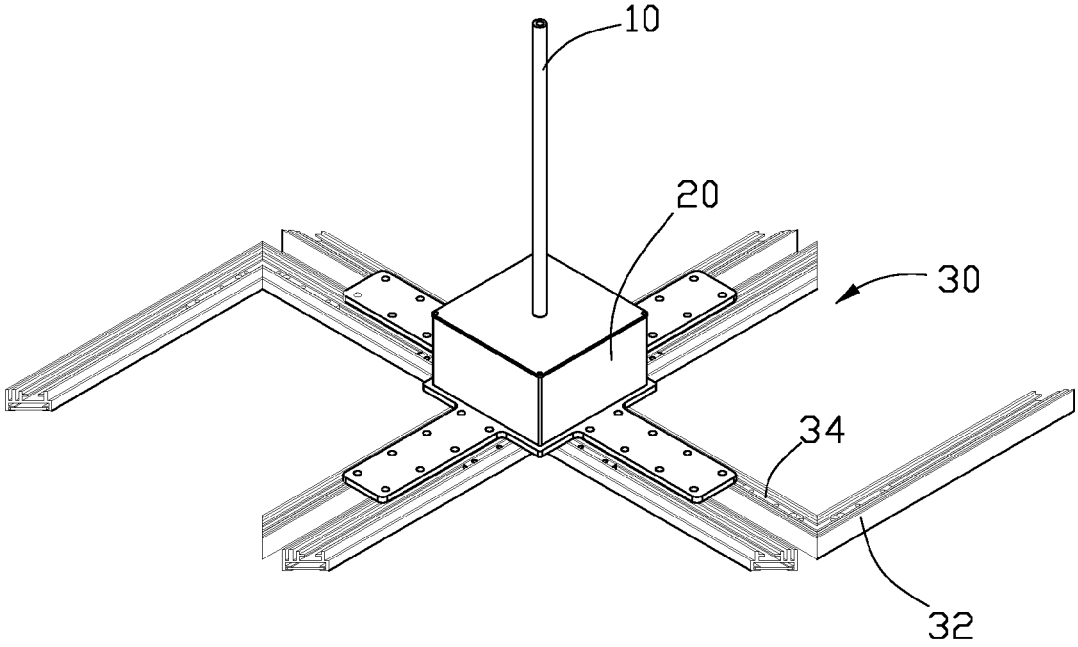
FIG. 5 is an isometric, assembled view of an LED lamp in accordance with a third embodiment of the disclosure.

FIG. 5 shows an LED lamp in accordance with a third embodiment of the disclosure, which has a similar configuration to that of the LED lamp in accordance with the second embodiment. The difference between the LED lamps in the second and third embodiments is that two of lamp bodies 30 in the third embodiment each have an L-shaped structure with two sides and include two lamp modules 32 and a bracket 34 connecting the two lamp modules 32 together; another two U-shaped lamp bodies 30 and the two L-shaped lamp bodies 30 are alternately connected together by the casing 20. The two L-shaped lamp bodies 30 in the third embodiment are symmetrical about the position post 10.

In the disclosure, the lamp bodies 30 can be arranged in a variety of forms by the brackets 34 connecting with different numbers of the lamp modules 32, and, thus, the LED modules 324 can obtain different illumination patterns and intensities to meet different illumination requirements.

It is believed that the disclosure and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:

a first lamp body comprising a plurality of lamp modules and at least a bracket connecting the lamp modules together, each of the lamp modules comprising a heat sink and an LED module attached to the heat sink;

a casing connecting the first lamp body;

a driving module received in the casing; and a position post secured to the casing for positioning the LED lamp at a required location;

wherein the first lamp body can be arranged in a variety of forms by the at least a bracket connecting different numbers of the lamp modules together, and the first lamp body has at least one of the following forms: a rectangular, loop-shaped form, an L-shaped form and a U-shaped form;

wherein the heat sink comprises a base plate and two pairs of rib plates oppositely extending from top and bottom faces of the base plate, respectively, the LED module being attached on the bottom face of the base plate;

wherein the heat sink further comprises a pair of baffle plates inwardly extending from the pair of rib plates at the top face of the base plate, respectively, one end of each bracket being sandwiched between the pair of baffle plates and the base plate; and wherein the first lamp body further comprises a cover plate fastened on the pair of baffle plates and covering the at least a bracket.

2. The LED lamp as claimed in claim 1, wherein two adjacent ones of the lamp modules connected by the at least a bracket are perpendicular to each other.

3. The LED lamp as claimed in claim 1, wherein the first lamp body has a U-shaped structure with three sides and comprises three lamp modules, and the at least a bracket has a number of two, the two brackets connecting the three lamp modules together.

4. The LED lamp as claimed in claim 3 further comprising a second lamp body having a U-shaped structure with three sides and comprising three lamp modules and two brackets connecting the three lamp modules together.

5. The LED lamp as claimed in claim 3 further comprising a second lamp body having an L-shaped structure with two sides and comprising two lamp modules and a bracket connecting the two lamp modules together.

6. The LED lamp as claimed in claim 1, wherein the first lamp body has a square, loop-shaped structure with four sides and comprises four lamp modules, and the at least a bracket has a number of four, the four brackets connecting the four lamp modules together.

7. The LED lamp as claimed in claim 1, wherein the heat sink further comprises two pairs of baffle plates inwardly extending from the pair of rib plates at the bottom face of the base plate, respectively, the LED module is located between the base plate and the pair of baffle plates near the base plate.

8. The LED lamp as claimed in claim 7, wherein each of the lamp modules further comprises a lens sandwiched between the two pairs of baffle plates.

9. The LED lamp as claimed in claim 1, wherein the casing comprises a bottom plate, a plurality of interconnecting side plates upwardly extending from the bottom plate, a flange outwardly extending from the bottom plate and a top plate connecting the side plates, the flange being connected to one of the lamp modules of the first lamp body.

10. The LED lamp as claimed in claim 9, wherein the position post extends through the top plate of the casing and engages with a nut.

* * * * *

UNITED STATES PATENT AND TRADEMARK OFFICE

CERTIFICATE OF CORRECTION

PATENT NO. : 8,092,048 B2
APPLICATION NO. : 12/491248
DATED : January 10, 2012
INVENTOR(S) : Shi-Song Zheng It is certified that error appears in the above-identified patent and that said Letters Patent is hereby corrected as shown below:

Title page, item (73) "Assignees" should read as follows:

(73) Assignees: Fu Zhun Precision Industry (ShenZhen) Co., Ltd., Shenzhen, Guangdong Province (CN); Foxconn Technology Co., Ltd., Tu-Cheng, New Taipei (TW).

Signed and Sealed this
Twenty-ninth Day of May, 2012

David J. Kappos

David J. Kappos
*Director of the United States Patent and Trademark Office*